United States Patent [19]

Dimitry

[11] 3,952,984

[45] Apr. 27, 1976

[54] MID-TOWER ROTARY ANTENNA MOUNT

[76] Inventor: Dracos Alexander Dimitry, 2317 Ardmore, Royal Oak, Mich. 48073

[22] Filed: Feb. 12, 1973

[21] Appl. No.: 331,826

[52] U.S. Cl. ..... 248/282; 343/764; 343/882

[51] Int. Cl.[2] ..... H01Q 3/00

[58] Field of Search ..... 248/282; 343/764, 765, 343/882; 74/37, 52, 785; 35/45

[56] References Cited

UNITED STATES PATENTS

| | | | |
|---|---|---|---|
| 239,644 | 4/1881 | Bowyer | 35/45 |
| 491,017 | 1/1893 | Huntman | 35/45 |
| 818,982 | 4/1906 | Skelley | 248/282 |
| 881,875 | 3/1908 | Trippensee | 35/45 |
| 2,556,026 | 6/1951 | Carlisle | 343/765 |
| 3,401,568 | 9/1968 | Blatt | 74/52 |
| 3,550,892 | 12/1970 | Propst | 248/282 |
| 3,693,922 | 9/1972 | Gueguen | 248/289 |
| 3,706,235 | 12/1972 | Duncan | 74/52 |

*Primary Examiner*—William H. Schultz
*Attorney, Agent, or Firm*—Willis Bugbee

[57] ABSTRACT

Bolted or otherwise secured in offset relationship to one of the legs of a radio or television tower or mast is a bracket to the top of which is fixedly secured an inner sprocket. Rotatably mounted in this bracket coaxial with the inner sprocket is an inner shaft to the top of which is fixedly secured the rearward hub of an inner arm. Rotatably mounted in the forward hub of the inner arm is an intermediate shaft to the lower end of which is fixedly secured a lower intermediate sprocket carrying an endless sprocket chain drivingly connecting it to the inner sprocket. Fixedly secured to the forward hub of the inner arm coaxial with the intermediate shaft above the lower intermediate sprocket is an upper intermediate sprocket. Fixedly secured to the upper end of the intermediate shaft is the rearward hub of an outer arm, in the forward hub at the outer end of which is journaled an outer shaft. Fixedly secured to the outer shaft is an outer sprocket drivingly connected by a sprocket chain to the upper intermediate sprocket. Fixedly connected to the upper end of the outer shaft is an antenna boom which in turn carries a conventional antenna array for radio or television communication. A torque motor is optionally mounted on the bracket and drivingly connected to the inner shaft for power-operation of the rotary antenna mount, or alternatively it may be rotated manually through suitable gearing.

1 Claim, 3 Drawing Figures

MID-TOWER ROTARY ANTENNA MOUNT

BACKGROUND OF THE INVENTION

Figures 1, 2, 3:
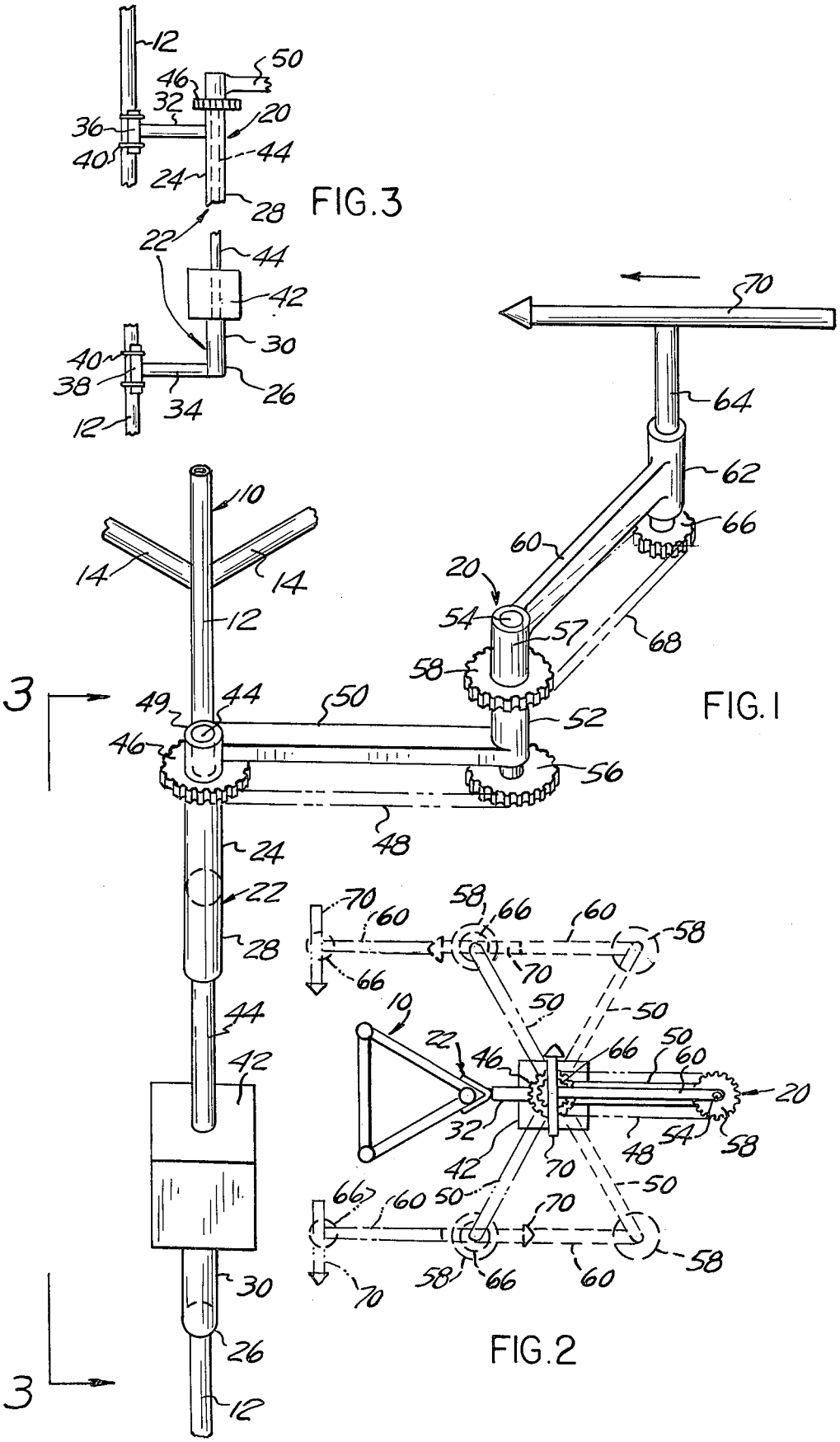

In radio communication it has been found advantageous to provide, below the upper rotary antenna array at the top of an antenna mast, a lower rotary antenna array rotatably mounted intermediate the top and bottom of the mast, and arranged to be rotated in synchronism with the upper antenna array, in order to create resonance with the upper antenna array. Mounting such a rotary lower resonance antenna array upon the mid-portion of a mast has hitherto also presented much difficulty, because of the difficulty of mounting a rotary bearing on the single upright involved therein. On the other hand, rotating the entire tower is even more difficult, for self-evident reasons. To mount such an antenna upon a tower composed of laterally spaced upright legs interconnected by struts, however, has hitherto prevented the mounting of such a lower antenna array because of the interference of the legs with the rotation of the lower antenna. The present invention is equally adaptable to mounting such an antenna upon a single upright, such as a mast, chimney or utility pole.

SUMMARY OF THE INVENTION

The present invention enables the mounting of a lower rotary antenna array upon the mid-section of a mast, a chimney, utility pole, or one of the legs of such a tower. As the same time, it facilitates the rotation of the antenna array by providing mechanism which simultaneously rotates it and swings it around the mast legs or other structure without interference therewith. At the same time, however, the invention provides mechanism which constantly maintains the orientation of the antenna boom in proper alignment with the antenna boom on the top or upper antenna array. Power-operated means is contemplated for effecting rotation of the lower antenna array so as to be in synchronism with the upper antenna array, or alternatively such rotation may be effected by manually operated mechanism.

IN THE DRAWING

FIG. 1 is an isometric view, looking downward from above, of a mid-tower rotary antenna mount secured to one of the legs of such a tower or other upstanding supporting structure;

FIG. 2 is a diagrammatic top plan view, upon a reduced scale, of the mid-tower rotary antenna mount of FIG. 1 in five different positions of orientation of the antenna boom relatively to a tripod tower of triangular cross-section having three convergent legs or uprights with an arrow head on the antenna boom to indicate its various orientations; and FIG. 3 is a fragmentary side elevation, upon a reduced scale, of the rearward portion of the antenna mount of FIG. 1 looking in the direction of the line 3—3 in FIG. 1, and showing the bracket structure by which the mount is attached to the tower or other upright supporting structure.

Referring to the drawing in detail, FIG. 1 shows a conventional antenna tower, generally designated 10, composed of upwardly-converging legs or uprights 12 interconnected at intervals by horizontal struts 14. The lower ends of the legs 12 are fixedly mounted in a conventional manner either in concrete or solid ground in a way well-known to those skilled in this art and beyond the scope of the present invention. The legs 12 and struts 14 of the tower 10 are of rigid material, such as aluminum, and are preferably of angle cross-section or of tubular construction for requisite rigidity.

Bolted or otherwise secured to one of the legs 12 intermediate the top and bottom thereof is a mid-tower rotary antenna mount, generally designated 20, according to one form of the invention. The mount 20 includes a bracket structure, generally designated 22, having upper and lower brackets 24 and 26 which in turn consist of uppper and lower bearing bosses 28 and 30 respectively welded or otherwise secured to the outer ends of fixed arms 32 and 34, the inner ends of which are welded or otherwise secured to angle feet 36 and 38 respectively secured by U-bolts or clamps 40 to the tower leg 12 intermediate its upper and lower ends. Mounted on the lower bushing 30 is a so-called torque box or power rotator 42 which is keyed or otherwise drivingly connected to the lower end portion of a rotary inner shaft 44 journaled in the bearing bushings 30 and 28.

Welded or otherwise fixedly secured to the upper end of the upper bearing boss 24 is an inner stationary sprocket 46 with which meshes an endless sprocket chain 48. Fixedly secured to the upper end of the inner shaft 44 is the rearward hub 49 of an inner arm 50, the outer end of which terminates in a forward hub or intermediate bearing bushing 52. Journaled in the forward hub or intermediate bearing bushing 52 is a rotary intermediate shaft 54. Keyed or otherwise drivingly secured to the lower end of the intermediate shaft 54 is a lower intermediate sprocket 56 which meshes with the endless sprocket chain 48. Welded or otherwise fixedly secured to the upper end of the intermediate bearing bushing 52 is an upper intermediate sprocket 58.

Keyed, welded or otherwise fixedly secured to the upper end of the intermediate shaft 54 is the rearward hub 57 of an outer arm 60 which terminates in a forward hub or outer bearing bushing 62. Rotatably mounted in the outer bearing bushing 62 is an outer rotary shaft 64, to the lower end of which an outer sprocket 66 is keyed or otherwise drivingly secured. An endless sprocket chain 68 drivingly connects the upper intermediate sprocket 58 to the outer sprocket 66. An antenna boom 70 is fixedly secured to the upper end of the outer shaft 64.

The inner sprocket 46, lower intermediate sprocket 56, and upper intermediate sprocket 58 are of the same diameter and same number of teeth, whereas the outer sprocket 66 is of a smaller diameter and smaller number of teeth. For example, assuming the sprockets 46, 56 and 58 to be for standard roller chains of 1 inch pitch, they would possess pitch diameters of 5.759 inches and outside diameters of 6.271 inches with eighteen teeth each, whereas the outer sprocket 66 would have a pitch diameter of 3.864 inches and an outside diameter of 4.332 inches and 12 teeth. Assuming that pulleys were substituted for the abovementioned sprockets, and also assuming that a non-slip V-belt or cog belt were used, the inner pulley 46 and the lower and upper intermediate pulleys 56 and 58 could possess diameters of 6 inches, whereas the outer pulley 66 would then possess a diameter of 4 inches. These dimensions may of course be varied while preserving the above-described 3 to 2 ratio between the diameters or numbers of teeth of the sprockets or pulleys 46, 56 and 58 and the sprocket or pulley 66.

In the operation of the invention, let it be assumed that a suitable conventional antenna array (not shown) has been mounted on the antenna boom 70 and that the bracket structure 22 of the mid-tower rotary antenna mount 20 has been secured to one of the legs 12 of the tower 10 as described above. Let it also be assumed that power is applied, either manually, through appropriate mechanism, or through the power-driven torque box 42, to rotate the inner shaft 44 within the inner bearing boss 28. The rotation of the inner shaft 44 swings the arm 50 fixedly secured thereto through an arcuate path. This in turn causes the sprocket chain 48 encircling and meshing with the inner stationary sprocket 46 to rotate the lower intermediate sprocket 56 and consequently to rotate the intermediate shaft 54 drivingly connected thereto.

The swinging of the inner arm 50 and of the intermediate bearing bushing 52 on the outer end thereof also swings, through an arcuate path, the upper intermediate sprocket 58 fixedly secured to the intermediate bearing bushing 52. At the same time, the rotation of the intermediate shaft 54 swings the outer arm 60 and outer bearing bushing 62 on the outer end thereof through an arcuate path while the outer sprocket 66 is rotated by the outer sprocket chain 68 meshing with the swinging (but not rotating) upper intermediate sprocket 58. As a result, the inner and outer arms 50 and 60 swing in arcuate paths around the axes of rotation of their respective shafts 44 and 54 while the intermediate shaft 54 is itself swinging in an arcuate path around the axis of the inner shaft 44 and is imparting to the outer bearing bushing 62 a motion in an arcuate path which is a composite of rotation around the axis of the intermediate shaft 54 and its swinging around the axis of the inner shaft 44. As a consequence, the antenna boom 70 moves freely around two sides of the tower 10 without colliding with the legs 12 thereof while the antenna boom 70 and the antenna array mounted thereon maintains its proper and desired orientation relatively to the tower 10 and to the upper antenna (not shown), if synchronized therewith, so as to produce resonance between the upper and mid-tower antenna arrays.

I claim:

1. A rotating and swinging antenna-orienting contrivance for mounting upon an upright of an upstanding radio communication antenna supporting structure intermediate its upper and lower ends, said contrivance comprising

- a bracket structure including a pair of substantially horizontal upper and lower bracket members disposed in vertically-spaced substantially parallel relationship and having upper and lower inner ends with attachment means thereon adapted to be attached to the upright of the antenna supporting sturcture in outwardly-projecting offset relationship thereto and having upper and lower outer ends spaced outwardly away from said inner ends, upper and lower inner bearings mounted on said upper and lower outer ends respectively in vertically-spaced coaxial relationship, an inner rotary member journalled in said inner bearings, an inner arm fixedly secured to said inner rotary member and having an intermediate bearing thereon disposed remote from said inner bearing in spaced parallel relationship thereto, an intermediate rotary member rotatably mounted in said intermediate bearing, an outer arm fixedly secured to said intermediate rotary member and having an outer bearing thereon disposed remote from said intermediate bearing in spaced parallel relationship thereto, an outer rotary load-carrying member rotatably mounted in said outer bearing, an inner driving device drivingly connecting said bracket structure to said intermediate rotary member and constructed and arranged to rotate said intermediate rotary member in response to the swinging of said inner arm by the rotation of said inner rotary member, an outer driving device drivingly connecting said inner arm to said outer rotary member and constructed and arranged to rotate said outer rotary member in response to the swinging of said outer arm relatively to said inner arm by the rotation of said intermediate rotary member, and a motor drivingly connected to said inner rotary member for rotating said inner rotary member.

* * * * *